US006974622B2

(12) United States Patent
Wade

(10) Patent No.: US 6,974,622 B2
(45) Date of Patent: Dec. 13, 2005

(54) PLASTIC SHEETS FOR USE IN PROTECTING OPENINGS IN WALLED STRUCTURES

(75) Inventor: Ashley Wade, Sulphur, LA (US)

(73) Assignee: Paragon Plastic Sheet, Inc., DeQuincy, LA (US)

( * ) Notice: Subject to any disclaimer, the term of this patent is extended or adjusted under 35 U.S.C. 154(b) by 7 days.

(21) Appl. No.: 10/345,829

(22) Filed: Jan. 16, 2003

(65) Prior Publication Data

US 2003/0134091 A1 Jul. 17, 2003

Related U.S. Application Data

(60) Provisional application No. 60/349,106, filed on Jan. 16, 2002.

(51) Int. Cl.[7] ..... E06B 3/30

(52) U.S. Cl. ..... 428/182; 428/59; 428/134; 428/136; 428/174; 428/179; 52/202; 52/203; 52/208

(58) Field of Search ..... 428/131, 132, 428/134, 136, 174, 177, 179, 59; 52/202, 52/203, 208

(56) References Cited

U.S. PATENT DOCUMENTS

| | | | | |
|---|---|---|---|---|
| 3,167,840 | A * | 2/1965 | Hoffman | 249/193 |
| 4,048,131 | A * | 9/1977 | Keske et al. | 524/377 |
| 4,229,504 | A * | 10/1980 | Brachman | 428/461 |
| 5,457,921 | A | 10/1995 | Kostrzecha | 52/202 |
| 5,996,292 | A * | 12/1999 | Hill et al. | 52/202 |
| 6,079,168 | A | 6/2000 | Shaver | 52/202 |
| 6,324,810 | B1 * | 12/2001 | Thompson | 52/713 |

OTHER PUBLICATIONS

The Online Knowledge Magazine, www.mistupid.com/homeimpr/lumber.htm.*
Merriam-Webster's Collegiate Dictionary, 10th ed., 1998, Merriam-Webster, Incorporated, p. 154.*
Brochure, Lookout Shutters Incorporated, Clear Storm Panel, SBCCI PST & ESI Final Evaluation No. 2109, Mar. 03, 2000, drawing Nos. 99-02; 99-01 pp. 1-5.
Brochure, Town & Country Industries, Inc., 0.040", 0.050", 0.060" Alum. & Clear Polycarbonate Storm Panels, drawing No. 99-029P, Jan. 26, 1999, pp. 1-7.
Brochure, Town & Country Industries, Inc., Storm Panel Supplementary Details, Drawing No. 01-283, p. 1 of 1.
Brochure, Poma Hurricane Storm Shutters, Poma Corporation, .050 Storm Panel Installation Instructions, Oct. 29, 1998, pp. 1-4.
Brochure, Safeguard Hurricane Protection Systems, Inc., 0.050" Perforated and Solid Aluminum Storm Panels, drawing No. 00-052, Aug. 17, 2000, p. 1 of 1.
Brochure, Protexan Hurricane Shutter System, drawing No. CP-99-001, pp. 1-6.
Brochure, Bertha Storm Panel Installation and Specification Guide, Eastern Metal Supply Inc., pp. 1-5.

* cited by examiner

*Primary Examiner*—Alicia Chevalier
(74) *Attorney, Agent, or Firm*—Dinsmore & Shohl LLP

(57) ABSTRACT

Sheets and sheet kits for use in protecting openings in a walled structure are provided. The sheets are generally plastic sheets having at least one corrugated region and a pair of lateral corrugated regions. The corrugated region and the lateral corrugated regions are configured such that the sheet can resist a missile weighing about 9.4 lbs (4.3 kgs), having a cross-sectional impact area of about 5.25 in$^2$ (34 cm$^2$), and impacting the sheet at a velocity of about 50 ft/s (15.24 m/s). The sheet kits include mounting tracks. It is emphasized that this abstract is provided to comply with the rules requiring an abstract which will allow a searcher or other reader to quickly ascertain the subject matter of the technical disclosure. It is submitted with the understanding that is will not be used to interpret or limit the scope or meaning of the claims. 37 CFR 1.72(b).

25 Claims, 4 Drawing Sheets

PLASTIC SHEETS FOR USE IN PROTECTING OPENINGS IN WALLED STRUCTURES

CROSS REFERENCE TO RELATED APPLICATION

This application claims priority to U.S. Provisional Application No. 60/349,106, filed Jan. 16, 2002.

BACKGROUND OF THE INVENTION

The present invention relates to plastic sheets, and more particularly to plastic sheets and systems that can be used to protect windows and doors in walled structures during a storm such as a hurricane.

Violent storms often generate strong winds that can damage or destroy property. The strong winds may carry debris that can impact against glass windows and doors and cause them to break. Storm shutter assemblies are known in the art. However, the prior art storm shutter assemblies are often costly and difficult to manufacture. Additionally, the prior art storm shutter assemblies may be difficult to install and may not offer adequate protection during violent storms. Thus, the present invention provides a storm shutter assembly that can be manufactured in a cost effective manner, can protect glass windows and doors from being destroyed by windborne debris, and can be easily installed and removed as needed.

SUMMARY OF THE INVENTION

In accordance with one embodiment of the present invention, a plastic sheet is provided. The sheet comprises top, bottom and lateral edges, a corrugated region oriented substantially parallel to the lateral edges, and a pair of lateral corrugated regions. The corrugated region comprises at least one substantially planar mounting region and at least one intermediate inclined region projecting away from the at least one planar mounting region in the direction of an adjacent corrugation. The pair of lateral corrugated regions comprise lateral corrugations along the lateral edges of the sheet. Each of the lateral corrugations have a substantially planar mounting region, an intermediate inclined region projecting away from the planar mounting region in the direction of an adjacent corrugation, and a lateral inclined region projecting away from the planar mounting region in the direction of one of the lateral edges. The corrugated region and the lateral corrugated regions are configured such that the sheet can resist a missile weighing about 9.4 lbs (4.3 kgs), having a cross-sectional impact area of about 5.25 $in^2$ (34 $cm^2$), and impacting the sheet at a velocity of about 50 ft/s (15.24 m/s).

In accordance with another embodiment of the present invention, a plastic sheet is provided. The sheet comprises top, bottom and lateral edges, a corrugated region oriented substantially parallel to the lateral edges, and a pair of lateral corrugated regions. The corrugated region comprises at least one substantially planar mounting region and at least one intermediate inclined region projecting away from the at least one planar mounting region in the direction of an adjacent corrugation. The pair of lateral corrugated regions comprise lateral corrugations along the lateral edges of the sheet, each of the lateral corrugations having a substantially planar mounting region, an intermediate inclined region projecting away from the planar mounting region in the direction of an adjacent corrugation, and a lateral inclined region projecting away from the planar mounting region in the direction of one of the lateral edges. The lateral inclined region projects a distance that is less than a distance projected by the intermediate inclined regions, and the plastic is selected from polypropylene, polyethylene, and combinations thereof.

In accordance with yet another embodiment of the present invention, a storm shutter kit for protecting an opening in a walled structure is provided. The kit comprises a pair of mounting tracks to be mounted to opposite sides of the opening, wherein each of the mounting tracks has a plurality of fasteners and each of the fasteners has a shank and a head, and a plurality of plastic sheets. Each of the sheets comprises top, bottom and lateral edges, a corrugated region oriented substantially parallel to the lateral edges, and a pair of lateral corrugated regions. The corrugated region comprises at least one substantially planar mounting region and at least one intermediate inclined region projecting away from the at least one planar mounting region in the direction of an adjacent corrugation. The pair of lateral corrugated regions comprise lateral corrugations along the lateral edges of the sheet. Each of the lateral corrugations have a substantially planar mounting region, an intermediate inclined region projecting away from the planar mounting region in the direction of an adjacent corrugation, and a lateral inclined region projecting away from the planar mounting region in the direction of one of the lateral edges. The corrugated region and the lateral corrugated regions are configured such that the sheet can resist a missile weighing about 9.4 lbs (4.3 kgs), having a cross-sectional impact area of about 5.25 $in^2$ (34 $cm^2$), and impacting the sheet at a velocity of about 50 ft/s (15.24 m/s). The lateral inclined region projects a distance that is less than a distance projected by the intermediate inclined regions such that a portion of one of the lateral corrugations of one of the sheets may be overlapped with a portion of one of the lateral corrugations of another one of the sheets to form a panel that substantially covers the opening. At least one mounting slot is provided adjacent to the top edge on the planar mounting region, and at least one mounting slot is provided adjacent to the bottom edge on the planar mounting region. The mounting slots are positioned and configured such that each of the sheets may be mounted to the mounting tracks by placing the fasteners through the mounting slots.

In accordance with yet another embodiment of the present invention, an assembly for protecting an opening in a walled structure is provided. The assembly comprises a pair of mounting tracks mounted to opposite sides of the opening wherein each of the mounting tracks has a plurality of fasteners, each of the fastener having a shank and a head. The assembly further comprises a plurality of plastic sheets. Each of the sheets comprises top, bottom and lateral edges, a corrugated region oriented substantially parallel to the lateral edges, and a pair of lateral corrugated regions. The corrugated region comprises at least one substantially planar mounting region and at least one intermediate inclined region projecting away from the at least one planar mounting region in the direction of an adjacent corrugation. The pair of lateral corrugated regions comprise lateral corrugations along the lateral edges of the sheet, each of the lateral corrugations having a substantially planar mounting region, an intermediate inclined region projecting away from the planar mounting region in the direction of an adjacent corrugation, and a lateral inclined region projecting away from the planar mounting region in the direction of one of the lateral edges. The corrugated region and the lateral corrugated regions are configured such that the sheet can resist a missile weighing about 9.4 lbs (4.3 kgs), having a cross-sectional impact area of about 5.25 $in^2$ (34 $cm^2$), and impacting the sheet at a velocity of about 50 ft/s (15.24 m/s). At least one mounting slot is provided adjacent to the top edge on the planar mounting region, and at least one mounting slot is provided adjacent to the bottom edge on the planar mounting region. The mounting slots are positioned and configured such that each of the sheets may be mounted to the mounting tracks by placing the fasteners through the mounting slots. A portion of one of the lateral corrugations of one of the sheets may be overlapped with a portion of one of the lateral corrugations of another one of sheets. The plurality of sheets are mounted to the mounting tracks to substantially cover the opening. The corrugated region, the lateral corrugated regions, and the mounting tracks are configured to withstand a pressure differential that reciprocates from about 0 to at least about 40 psf across first and second sides of the plurality of sheets.

In accordance with another embodiment of the present invention, a storm shutter kit for protecting an opening in a walled structure is provided. The kit comprises a pair of mounting tracks to be mounted to opposite sides of the opening, wherein each of the mounting tracks has a plurality of fasteners and each of the fasteners has a shank and a head, and a plurality of high density polyethylene sheets. Each of the sheets comprises top, bottom and lateral edges, a corrugated region oriented substantially parallel to the lateral edges, and a pair of lateral corrugated regions. The corrugated region comprises at least one substantially planar mounting region and at least one intermediate inclined region projecting away from the at least one planar mounting region in the direction of an adjacent corrugation. The pair of lateral corrugated regions comprise lateral corrugations along the lateral edges the sheet. Each of the lateral corrugations has a substantially planar mounting region, an intermediate inclined region projecting away from the planar mounting region in the direction of an adjacent corrugation, and a lateral inclined region projecting away from the planar mounting region in the direction of one of the lateral edges. The lateral inclined region projects a distance that is less than a distance projected by the intermediate inclined regions such that a portion of one of the lateral corrugations of on of the sheets may be overlapped with a portion of one of the lateral corrugations of another one of the sheets to form a panel that substantially covers the opening. At least one double key-way type slot is provided adjacent to the top edge on the planar mounting region, and at least one double key-way type slot is provided adjacent to the bottom edge on the planar mounting region. The double key-way type slots have an enlarged portion larger than the head of the fastener, an upper portion smaller than the head of the fastener, and a lower portion smaller than the head of the fastener. The double key-way type slots are reinforced by an insert arranged along a periphery of the double key-way type slots. The double key-way type slots are positioned and configured such that each of the sheets may be mounted to the mounting tracks by placing the fasteners through the double key-way type slots.

BRIEF DESCRIPTION OF THE SEVERAL VIEWS OF THE DRAWINGS

The following detailed description of the preferred embodiments of the present invention can be best understood when read in conjunction with the following drawings, in which.

DETAILED DESCRIPTION OF THE PREFERRED EMBODIMENTS

Figure 1:
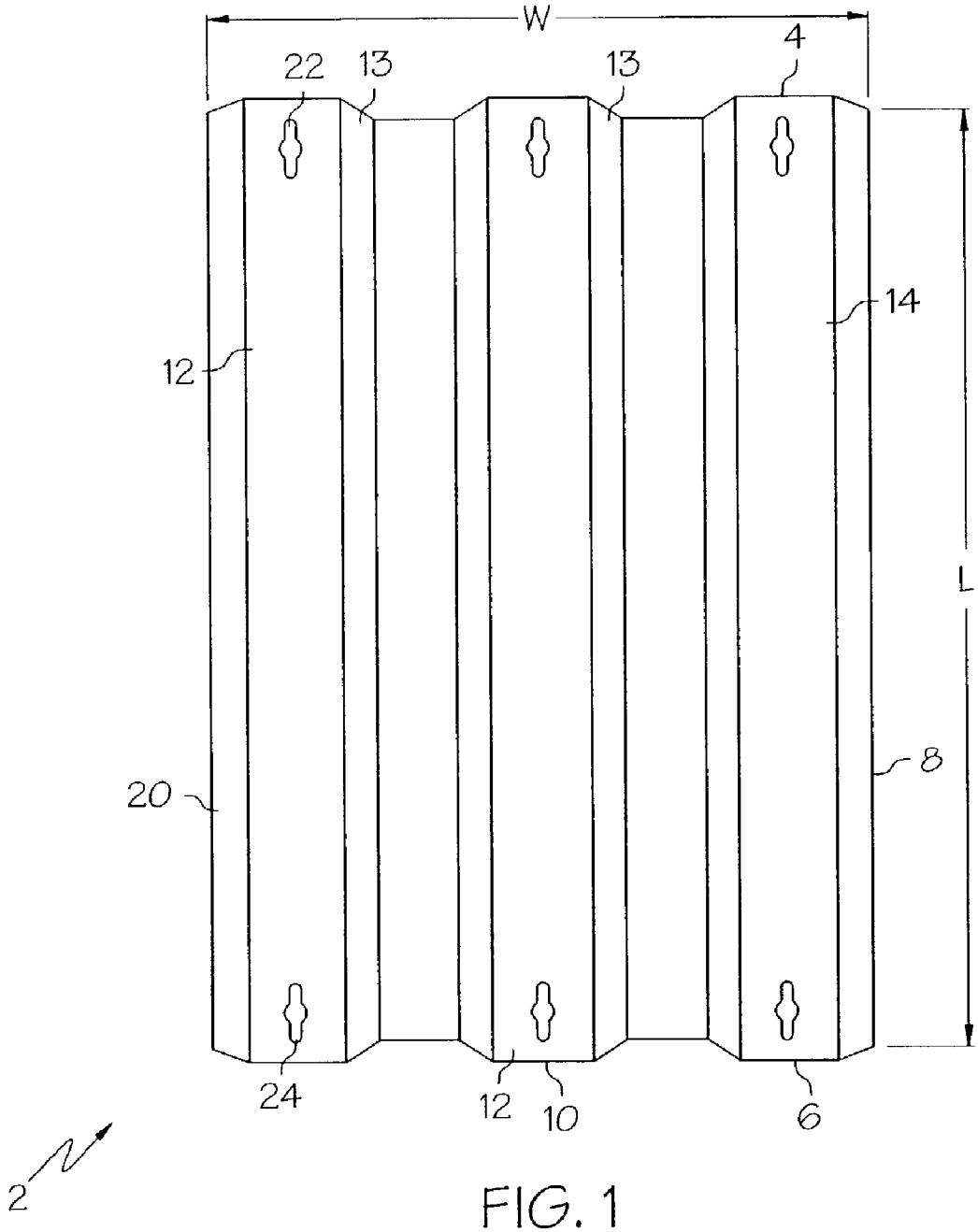
FIG. 1 is an plan illustration of a sheet in accordance with the present invention.
Figure 2:
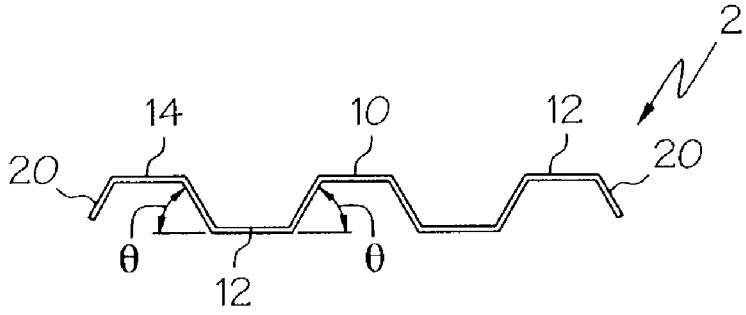
FIG. 2 is a cross-sectional illustration of a sheet in accordance with the present invention.

Referring to FIGS. 1 and 2, a sheet 2 in accordance with one embodiment of the present invention is illustrated. The sheet 2 has top 4, bottom 6, and lateral edges 8. The sheet 2 has a corrugated region 10 that is oriented substantially parallel to the lateral edges 8. Additionally, the sheet has a pair of lateral corrugated regions 14. The corrugated region 10 generally has at least one planar mounting region 12 and at least one intermediate inclined region 13. The intermediate inclined region 13 projects away from the planar mounting region 12 in the direction of an adjacent corrugation. It will be understood by those having skill in the art that the corrugated region 10 may have any suitable number of planar mounting regions 12 and intermediate inclined regions 13. Increasing the number of planar mounting regions 12 and the number of intermediate inclined regions 13 will generally increase the number of corrugations or the width W of the panel.

The pair of lateral corrugated regions 14 are lateral corrugations along the lateral edges 8 of the sheet 2. Each of the lateral corrugations 14 have a substantially planar mounting region 12 and an intermediate inclined region 13 projecting away from the planar mounting region 12 in the direction of an adjacent corrugation. The lateral corrugations 14 also have a lateral inclined region 20 projecting away from the planar mounting region 12 in the direction of one of the lateral edges. The corrugated region 10 and the lateral corrugated regions 14 are generally configured such that the sheet 2 can resist a missile weighing about 9.4 lbs (4.3 kgs) having a cross-sectional impact area of about 5.25 $in^2$ (34 $cm^2$) and impacting the sheet 2 at a velocity of about 50 ft/s (15.24 m/s).

The lateral inclined region 20 may project a distance that is less than a distance projected by the intermediate inclined regions 13. The lateral inclined region 20 may be any suitable length. For example, the lateral inclined region 20 may be about 1¼ inches long. Generally, the lateral inclined region 20 is configured to provide adequate overlap when the sheets 2 are mounted as described hereinafter.

Referring to FIG. 1, the sheet 2 may be formed in any suitable width. For example, the sheet may have a width W of about 13.5 inches. However, this width W may vary depending on the size of the opening that is to be covered with the sheets 2 of the present invention. Similarly, the length L of the sheet may vary depending on the length of the opening that is to be covered.

Figure 3:
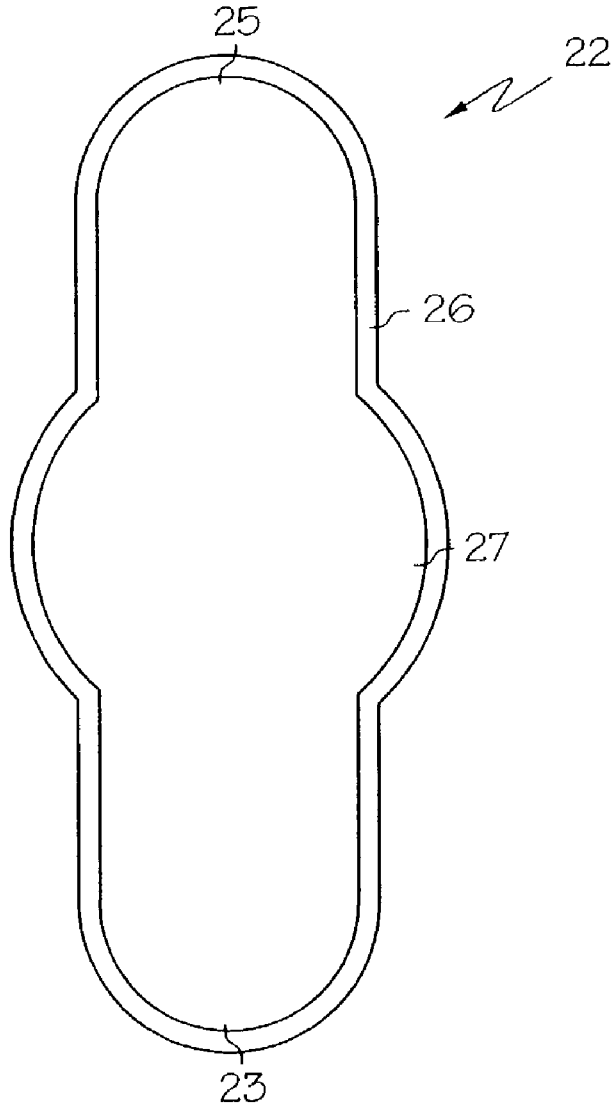
FIG. 3 is an illustration of a mounting slot in accordance with the present invention.

Referring to FIGS. 1 and 3, at least one of the corrugated region 10 and the lateral corrugated regions 14 may also have at least one first and second mounting slots 22, 24. The first mounting slot 22 may be adjacent to the top edge 4 of the sheet 2, and the first mounting slot 22 may be disposed on a planar mounting region 12. The second mounting slot 24 may be adjacent to the bottom edge 6 of the sheet 2, and the second mounting slot 24 may be disposed on a planar mounting region 12. The first mounting slot 22 and the second mounting slot 24 may have inserts 26 that are arranged about the periphery of the mounting slots 22, 24 and provide reinforcement. The inserts 26 may be formed of any suitable material. For example, the inserts 26 may be metal, such as aluminum, or the inserts may be formed from plastic. The inserts 26 may help to prevent tearing of the mounting slots 22, 24 when the sheet 2 is mounted as described hereinafter.

In accordance with one embodiment of the present invention, at least one of the first mounting slots 22 may be a key-way type mounting slot. For purposes of defining and describing the present invention, a "key-way type mounting slot" is a mounting slot having at least one portion that is smaller than a head of a fastener and at least one portion that is larger than head of the fastener. Additionally, at least one of the second mounting slots 24 may be a key-way type mounting slot. The key-way type mounting slot may be a single key-way mounting slot having one portion that is larger than head of a fastener and one portion that is smaller than the head of a fastener. The key-way type mounting slots may be double key-way type slots having an enlarged portion 27 larger than the head of a fastener and upper 25 and lower 23 portions smaller than the head of a fastener.

In accordance with another embodiment of the present invention, at least one of the first mounting slots 22 may be a mounting slot suitable for receiving the shank of a fastener. Additionally, at least one of the second mounting slots may be a mounting slot suitable for receiving the shank of a fastener.

Referring again to FIGS. 1 and 2, the sheet 2 is generally a plastic sheet. The sheet 2 may be made of any suitable plastic that will provide suitable impact resistance to protect a door or window from windborne debris. For example, the sheet 2 may be made of any suitable polypropylene plastic. For example, the sheet 2 may be made from Pro-fax® SG702 available from Montell Polyolefins (Wilmington, Del.). Alternatively, the sheet 2 may be made from any suitable polyethylene. Additionally, the sheet 2 may be made from any suitable high density polyethylene (HDPE). For purposes of defining and describing the present invention, HDPE is to be understood as referring to polyethylenes having a density above about 0.940 g/cm$^3$. For example, the sheet 2 may be made from Paxon AF50-003 Blow Molding Resin, Paxon AA60-003 Blow Molding Resin, and Paxon BA50-100 Sheet Extrusion and Blow Molding Resin all available from ExxonMobil Chemical (Houston, Tex.).

Generally, suitable plastics include those having a tensile strength at yield as measured by ASTM test method D638 of less than about 5500 psi. More generally, suitable plastics include those having a tensile strength at yield of about 3,000 psi to about 4,600 psi. Additionally, suitable plastics include those having a flexural modulus as measured by ASTM test method D790 of less than about 250,000 psi, and, more generally, suitable plastics include those having a flexural modulus of about 150,000 psi to about 235,000 psi. The sheet 2 may be formed using extrudable plastics, and the sheet 2 may be formed using a translucent plastic. The plastic sheet 2 generally has a wall thickness of about 0.060 to about 0.250 inches, and, more generally, the plastic sheet 2 has a wall thickness of about 0.125 inches to about 0.250 inches.

Referring to FIG. 2, the inclined regions 13 and the lateral inclined regions 20 may be formed such that they project from the substantially planar mounting regions 12 at an angle θ. The angle θ may be between about 10° to about 90°. More generally, the angle θ is between about 45° to about 55°. It will be understood by those having skill in the art that each individual inclined region 13 and lateral inclined region 20 may project at a different angle θ.

The sheet 2 may be formed using any suitable plastic forming method. For example, the sheet may be formed using a thermo-forming or injection molding process. The sheet 2 may alternatively be formed by any suitable extrusion processes and apparatuses. For example, a variety of suitable extrusion apparatus are described in U.S. patents classified in class 425 subclasses 369 (apparatus wherein reshaping means creates accordion-like pleats or wrinkles or the like in a perform by distorting a section thereof transverse to its axis into a plurality of reversing curves) and 336 (apparatus comprising means for shaping an advancing length of work into ridges and grooves). It is generally not preferred to form the sheet 2 utilizing a profile extrusion because the sheet 2 may deform during the rapid cooling steps typically associated with profile extrusion.

Figure 4:
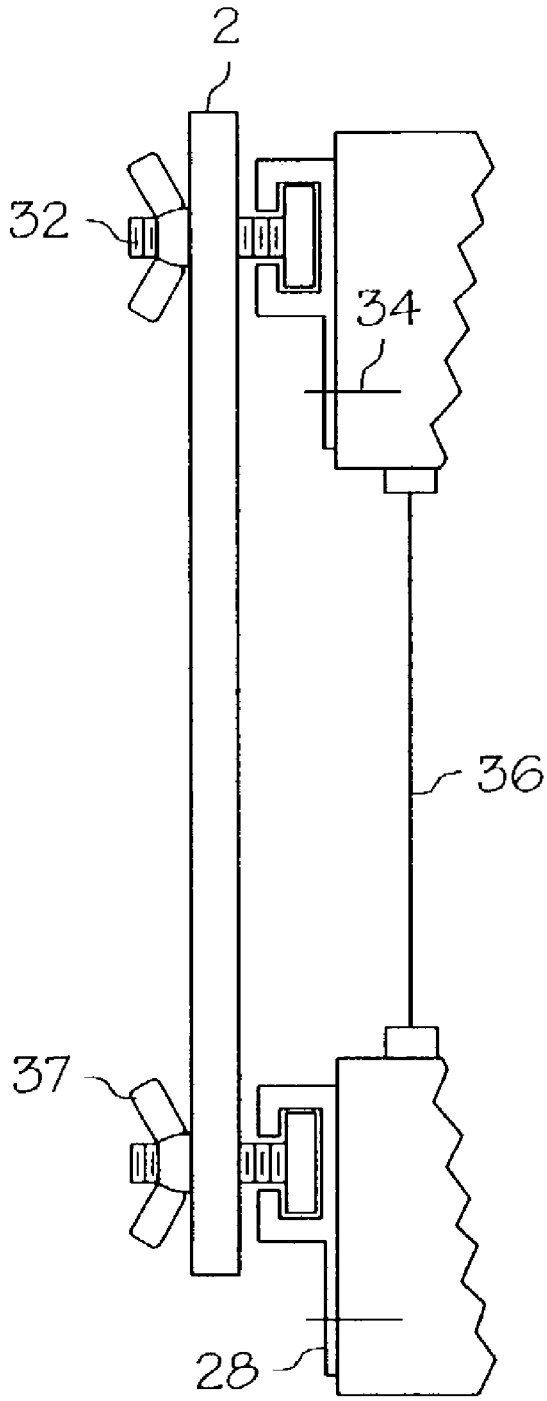
FIG. 4 is side view of one embodiment of a sheet kit in accordance with the present invention.
Figure 5:
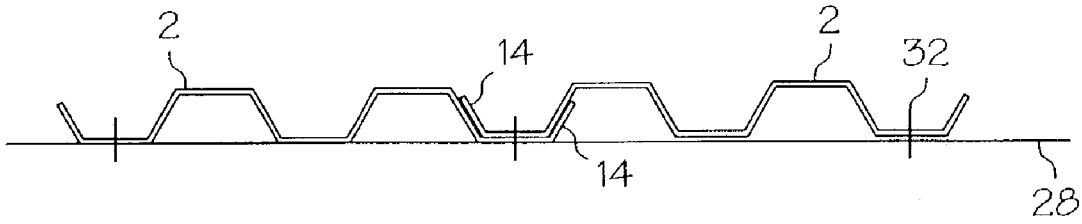
FIG. 5 is a cross-sectional view of one embodiment of a sheet kit in accordance with the present invention.

In accordance with one embodiment of the present invention, a storm shutter kit and an assembly for protecting an opening in a walled structure is provided. Referring to FIGS. 4 and 5, the kit and assembly may utilize mounting tracks 28. The mounting tracks 28 may be mounted to opposite sides of an opening 36, and the mounting tracks 28 may be mounted utilizing any suitable fastener 34. For example, the mounting tracks 28 may be mounted on the top and bottom of an opening such as a window. Alternatively, the mounting tracks 28 may be mounted on lateral sides of an opening such as a window. The mounting tracks 28 may be of any suitable configuration and be made of any suitable material. The mounting tracks 28 may be made from metal, plastic, or the like.

One suitable mounting track system is illustrated in FIGS. 4 and 5. The mounting track 28 is configured to hold a fastener 32 such that the shank of the fastener 32 is disposed to receive the sheet 2. As shown in FIG. 5, the sheets 2 may be mounted such that a portion of one lateral corrugated region 14 overlaps with a portion of another lateral corrugated region. In this manner, the sheets 2 may be used to substantially cover the opening 36. Additionally, this. overlap of the sheets 2 may assist in preventing objects from passing between the sheets 2 into the opening 36 during a storm.

Additionally, the corrugated region 10, the lateral corrugated regions 14, and the mounting tracks 28 may be configured to withstand a pressure differential that reciprocates from about 0 to at least about 40 psf across first and second sides of the sheet 2 when the sheets are mounted. The pressure differential may reciprocate from about 0 up to at least about 150 psf across the first and second sides of the sheet 2. It shall be understood by those having skill in the art that "withstand" refers to the sheet, sheets, and/or mounting tracks not being subject to failure under the pressure differential. For example, failure may mean a sheet or sheets breaking away from the mounting tracks, a sheet or sheet tearing, a mounting track or tracks loosening, and the like.

Referring to FIGS. 1, 4, and 5, when mounting the sheet 2, the user generally places the shank of the track fasteners 32 into the mounting slots 22, 24 of the sheet. Cross-sectional lines in FIG. 4 have been omitted for clarity. The user may then secure the sheet 2 to the track 28 by utilizing a wing nut 37 or other suitable securing means. The mounting slots 22, 24 may be single or double key-way type slots or may be any opening configured to allow the shank of the track fasteners 32 to pass therethrough.

Figure 6:
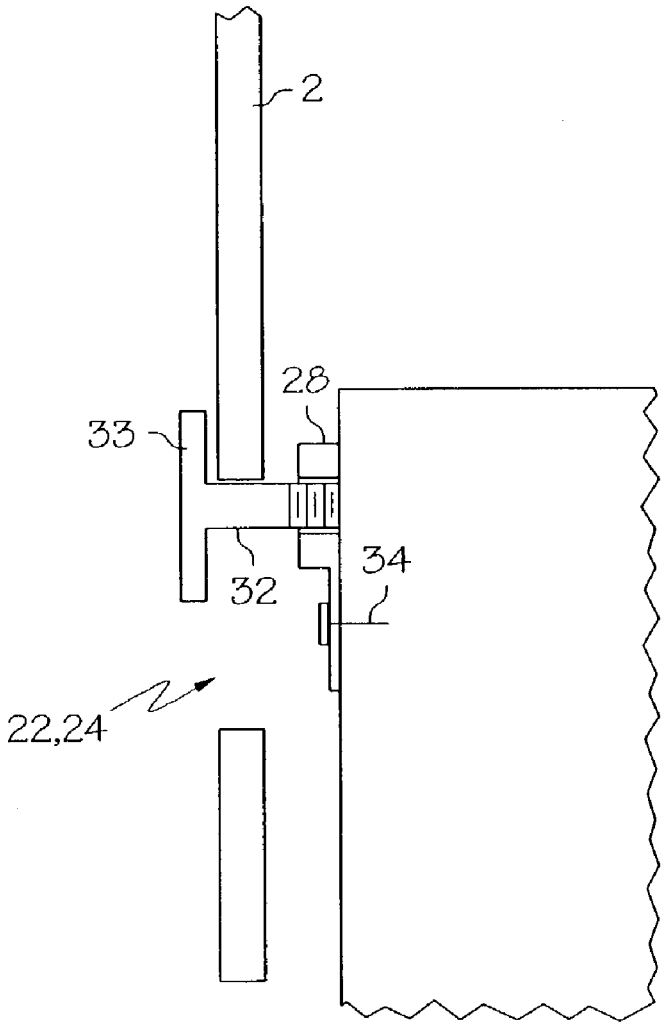
FIG. 6 is a partial cross-sectional view of another embodiment of a sheet kit in accordance with the present invention.

Referring to FIGS. 1 and 6, another suitable mounting track 28 configuration is illustrated, and cross-sectional lines in FIG. 6 have been omitted for clarity. The mounting track 28 is configured to hold a fastener 32 such that the head 33 is disposed to receive the sheet 2. The fastener 32 may be secured to the track 28 in any suitable fashion. For example, the fastener 32 may be threaded into the track 28 or the track 28 may be formed integrally around the fastener 32. The mounting slots 22, 24 may be single key-way type slots, and the user may mount the sheet 2 by ensuring that the head 33 of the fastener 32 is placed in the region of the mounting slot 22, 24 that is larger than the head 33 and then clicking the sheet 2 into place by ensuring that the fastener 32 is in the region of the mounting slot that is smaller than the head 33.

Similarly, the mounting slot 24 may be a double key-way type slot, and the user may mount the sheet 2 in a similar manner to that employed for a single key-way type slot. When the mounting slots 22, 24 are double key-way type slots, the user does not need to distinguish between the top 4 and bottom 6 edges of the sheet 2 because the mounting slots 22, 24 may be utilized in either position. Thus, the sheets 2 may generally be easily mounted without requiring special tools or requiring that the sheets 2 be used in a particular order. Additionally, when the key-way type slots are utilized over the head 33 of the fastener 32, installation of the sheets 2 is eased because no additional parts such as wing nuts are needed.

Generally, the sheets 2 and sheet kits of the present invention do not require any reinforcement bars running parallel to or perpendicular to the width W through the center of the sheet 2 because the sheet 2 is formed from a suitable plastic and is stiff enough to provide adequate storm protection without reinforcement. Thus, a user may easily install the sheets 2 to protect an opening in a walled structure in a short period of time.

It will be obvious to those skilled in the art that various changes may be made without departing from the scope of the invention, which is not to be considered limited to what is described in the specification.

What is claimed is:

1. A plurality of corrugated plastic sheets comprising a first corrugated sheet and a second corrugated sheet, each corrugated sheet comprising an intermediate corrugated region and a pair of lateral corrugated regions disposed on opposite sides of said intermediate corrugated region, wherein:

said intermediate corrugated region comprises at least one substantially planar mounting region and at least one inclined intermediate region projecting away from said planar mounting region in the direction of an adjacent corrugation; and said pair of lateral corrugated regions comprise lateral corrugations along lateral edges of said sheet, each of said lateral corrugations having a substantially planar mounting region, an intermediate inclined region projecting away from said planar mounting region in the direction of an adjacent corrugation, and a lateral inclined region projecting away from said mounting region in the direction of one of said lateral edges;

said corrugated region and said lateral corrugated regions are configured such that said sheet can resist a missile weighing about 9.4 lbs (4.3 kgs), having a cross-sectional impact area of about 5.25 $in^2$ (34 $cm^2$), and impacting said sheet at a velocity of about 50 ft/s (15.24 m/s);

said lateral inclined region of one of said lateral corrugations of said second sheet overlaps said intermediate inclined region of one of said lateral corrugations of said first sheet for at least a majority of the cross-sectional extent of said intermediate inclined region;

said planar mounting region of said lateral corrugation of said second sheet overlaps said planar mounting region of said lateral corrugation of said first sheet;

said intermediate inclined region of said lateral corrugation of said second sheet overlaps said lateral inclined region of said lateral corrugation of said first sheet for at least a majority of the cross-sectional extent of said intermediate inclined region; and said lateral corrugations and said corrugations adjacent thereto define corrugations of substantially the same size and geometry.

2. A plurality of corrugated plastic sheets as claimed in claim 1 wherein said lateral inclined region projects a distance that is less than a distance projected by said intermediate inclined regions.

3. A plurality of corrugated plastic sheets as claimed in claim 1 wherein at least one of said corrugated region and said lateral corrugated regions further comprise:

at least one first mounting slot adjacent to said a top edge of said sheet, wherein said first mounting slot is disposed on said planar mounting region; and at least one second mounting slot adjacent to a bottom edge of said sheet, wherein said second mounting slot is disposed on said planar mounting region, and wherein said first and second mounting slots are reinforced by an insert arranged along the periphery of said first and second mounting slots.

4. A plurality of corrugated plastic sheets as claimed in claim 3 wherein said insert is metal.

5. A plurality of corrugated plastic sheets as claimed in claim 3 wherein said insert is plastic.

6. A plurality of corrugated plastic sheets as claimed in claim 3 wherein said at least one first mounting slot is a key-way type mounting slot.

7. A plurality of corrugated plastic sheets as claimed in claim 3 wherein said at least one second mounting slot is a key-way type mounting slot.

8. A plurality of corrugated plastic sheets as claimed in claim 3 wherein said at least one first mounting slots and said at least one second mounting slots are key-way type mounting slots.

9. A plurality of corrugated plastic sheets as claimed in claim 1 wherein at least one of said corrugated region and said lateral corrugated regions further comprise:

at least one first key-way type slot adjacent to top edge of said sheet, wherein said first key-way type slot is disposed on said planar mounting region to receive a fastener having a head and a shank; and at least one second key-way type slot adjacent to a bottom edge of said sheet, wherein said second key-way type slot is disposed on said planar mounting region to receive a fastener having a head and a shank, said first and second key-way type slots having an enlarged portion larger than said head of said fastener and an upper portion and a lower portion smaller than said head of said fastener.

10. A plurality of corrugated plastic sheets as claimed in claim 1 wherein said plastic has a tensile strength at yield of less than about 5500 psi.

11. A plurality of corrugated plastic sheets as claimed in claim 10 wherein said plastic has a tensile strength at yield of about 3,000 psi to about 4,600 psi.

12. A plurality of corrugated plastic sheets as claimed in claim 1 wherein said plastic has a flexural modulus of less than about 250,000 psi.

13. A plurality of corrugated plastic sheets as claimed in claim 12 wherein said plastic has a flexural modulus of about 150,000 psi to about 235,000 psi.

14. A plurality of corrugated plastic sheets as claimed in claim 1 wherein said plastic is extrudable.

15. A plurality of corrugated plastic sheets as claimed in claim 1 wherein said plastic comprises polyethylene.

16. A plurality of corrugated plastic sheets as claimed in claim 15 wherein said plastic comprises high density polyethylene.

17. A plurality of corrugated plastic sheets as claimed in claim 1 wherein said plastic comprises polypropylene.

18. A plurality of corrugated plastic sheets as claimed in claim 1 wherein said plastic is translucent.

19. A plurality of corrugated plastic sheets as claimed in claim 1 wherein said plastic sheet has a wall thickness in the range of about 0.060 to about 0.250 inches.

20. A plurality of corrugated plastic sheets as claimed in claim 19 wherein said wall thickness is in the range of about 0.125 to 0.250 inches.

21. A plurality of corrugated plastic sheets as claimed in claim 1 wherein said intermediate inclined regions project away from said planar mounting regions at an angle between about 10° to about 90°.

22. A plurality of corrugated plastic sheets as claimed in claim 1 wherein said lateral inclined regions project away from said planar mounting regions at an angle between about 10° to about 90°.

23. A plurality of corrugated plastic sheets as claimed in claim 1 wherein said intermediate inclined regions project away from said planar mounting regions at an angle between about 45° to about 55°.

24. A plurality of corrugated plastic sheets as claimed in claim 1 wherein said lateral inclined regions project away from said planar mounting regions at an angle between about 45° to about 55°.

25. A plurality of corrugated plastic sheets comprising a first corrugated sheet and a second corrugated sheet, each corrugated sheet comprising an intermediate corrugated region and a pair of lateral corrugated regions disposed on opposite sides of said intermediate corrugated region, wherein:

said intermediate corrugated region comprises at least one substantially planar mounting region and at least one inclined intermediate region projecting away from said planar mounting region in the direction of an adjacent corrugation; and said pair of lateral corrugated regions comprise lateral corrugations along lateral edges of said sheet, each of said lateral corrugations having a substantially planar mounting region, an intermediate inclined region projecting away from said planar mounting region in the direction of an adjacent corrugation, and a lateral inclined region projecting away from said mounting region in the direction of one of said lateral edges;

said corrugated region and said lateral corrugated regions are configured such that said sheet can resist a missile weighing about 9.4 lbs (4.3 kgs), having a cross-sectional impact area of about 5.25 $in^2$ (34 $cm^2$), and impacting said sheet at a velocity of about 50 ft/s (15.24 m/s);

said lateral inclined region of one of said lateral corrugations of said second sheet overlaps said intermediate inclined region of one of said lateral corrugations of said first sheet for at least a majority of the cross-sectional extent of said intermediate inclined region;

said planar mounting region of said lateral corrugation of said second sheet overlaps said planar mounting region of said lateral corrugation of said first sheet;

said intermediate inclined region of said lateral corrugation of said second sheet overlaps said lateral inclined region of said lateral corrugation of said first sheet for at least a majority of the cross-sectional extent of said intermediate inclined region; and at least one of said corrugated region and said lateral corrugated regions further comprise at least one double key-way type slot adjacent to a top edge of said sheet and at least one double key-way type slot adjacent to a bottom edge of said sheet, wherein said double key-way type slots are disposed on said planar mounting region to receive a fastener having a head and a shank, said double key-way type slots comprise an enlarged portion larger than said head of said fastener and upper and lower portions smaller than said head of said fastener, and said double key-way type slots are positioned adjacent to said top and bottom edges of said sheet such that said corrugated sheets can be utilized without the need to distinguish between said top and bottom edges of said sheet.

* * * * *

UNITED STATES PATENT AND TRADEMARK OFFICE

CERTIFICATE OF CORRECTION

PATENT NO. : 6,974,622 B2
APPLICATION NO. : 10/345829
DATED : December 13, 2005
INVENTOR(S) : Ashley Wade It is certified that error appears in the above-identified patent and that said Letters Patent is hereby corrected as shown below:

Col. 8, line 23 "said" should be deleted.

Signed and Sealed this

Twelfth Day of September, 2006

JON W. DUDAS
*Director of the United States Patent and Trademark Office*